United States Patent [19]

Bersonnet

[11] Patent Number: 4,771,148

[45] Date of Patent: Sep. 13, 1988

[54] EXERCISE MACHINE SWITCH

[75] Inventor: George Bersonnet, River Heights, Utah

[73] Assignee: Weslo, Inc., Logan, Utah

[21] Appl. No.: 9,297

[22] Filed: Jan. 30, 1987

[51] Int. Cl.[4] ..... H01H 3/16; H01H 4/06; A63B 23/06

[52] U.S. Cl. ..... 200/61.58 R; 200/61.85; 272/69

[58] Field of Search ..... 200/61.85, 43.16, 43.18, 200/43.04, 43.06, 321, 157, 333, 334, 50 C, 17 R, 61.58 R; 123/198 DB, 198 DC; 272/69

[56] References Cited

U.S. PATENT DOCUMENTS 2,426,001 8/1947 Denault ..... 200/43.16 X
3,711,812 1/1973 Cherry ..... 200/50 C X
4,458,115 7/1984 Peterson ..... 200/61.85
4,563,552 1/1986 Fushimoto ..... 200/334 X
4,614,848 9/1986 Schulte et al. ..... 200/61.85

*Primary Examiner*—J. R. Scott
*Attorney, Agent, or Firm*—Trask, Britt & Rossa

[57] ABSTRACT

A safety switch for electrical or powered exercise equipment is provided. The switch includes a switch body slidingly connected to a bar section of typical exercise equipment. The switch body slides to operate a connected electrical switch. To turn on the equipment, a user depresses a button connected to the switch body and slides the switch on. To turn off, the exerciser need only slide the switch body back to its original position. The switch is adapted and located so that during a fall, the motion of the exerciser's body would typically be in the direction of the off position of the switch.

4 Claims, 3 Drawing Sheets

EXERCISE MACHINE SWITCH

BACKGROUND OF THE INVENTION

1. Field

The present invention relates to switches for powered exercise equipment. More particularly, the present invention relates to a switch that requires two separate actions by the user to turn the equipment on but only one to turn the equipment off.

2. State of the Art

Some types of exercise equipment such as treadmills may be powered or motorized. Occasionally a user may slip or fall and become entangled in the equipment or be thrown from the equipment due at least in part because the user was not able to turn the equipment off. This may be particularly a problem with aged or handicapped persons who may have trouble keeping up with the motorized equipment and with those who may more easily loose their balance and fall.

Typically, the electrical switch for powered exercise equipment is a simple two position ("on" and "off") switch such as a toggle or sliding switch. These types of switches need only be operated by a single motion to the "on" position to activate the equipment. Because such a switch may be easily and even accidentally operated, the risk of injury due to accidental or unintentional operation to the "on" condition is apparent. That is, a user may unintentionally touch or operate the switch activitating the equipment when the user is not ready. Similarly, the user may have trouble locating the switch while using the machine to quickly turn the equipment off in the event of a stumble or an emergency. In other words, typical switches such as toggle or sliding switches may be somewhat easily and accidentally turned on but may be difficult to find and turn off in an emergency. Thus, a user may not be able to timely deactivate powered exercise equipment to minimize the risk of a fall and the risk of a concomitant injury.

Other types of powered equipment such as milling machines, lathes, table saws and the like may typically be found to have some type of safety switch arrangement to preclude inadvertent activation and facilitate access for rapid or quick deactivation. However, powered exercise machines and in particular treadmills with safety switch structure are heretofore unknown. Further structure to facilitate operation by a moving or falling user is also unknown.

SUMMARY OF THE INVENTION

A switch assembly for powered exercise machines is structured to require two independent actions to turn the equipment "on," but only one action to turn the equipment "off." To turn the equipment "on," the user must operate locking means and then slide structure to place switch means in the "on" position. To turn the equipment off, a user need only slide the structure to place the switch means in the "off" position.

The switch assembly for operation of a powered exercise machine includes a base, a switch, a body, locking means and connection means. The base is mechanically associated with the machine and is preferably part of the machine chassis or structure such as the associated handle structure. The switch is adapted to the base, preferably thereunder. The switch is moveable between "on" and "off" positions. Body means is adapted to slide over the base between first and second positions to move the switch between the "off" and "on" positions respectively. Locking means associated with the body means is operable between an "operate" position in which the body means is moveable between the first and second positions and an "inhibit" position in which the body means is not moveable from the first position. Connection means is provided so that operation of the body from the first means to the second position results in operation of the switch between from the "off" to the "on" position with the locking means in an "operate" position. With the locking means in the "inhibit" position, the body is moveable only from the second position to the first position.

The switch preferably is the type with a toggle or operating member extending away therefrom. Desirably the operating member registers with and extends through the base to register either with an aperture in the body or with pawls positioned to move the operating member.

The locking means is desirably a button with a shaft extending therefrom having a head on the distal end to register with a keyhole shaped aperture. In the "operate" position, the head passes through the a first portion of the keyhole aperture allowing movement of the shaft into a second narrower portion of the keyhole aperture. In the "inhibit" position, the head registers with the first portion to prevent movement of the body means.

The exercise machine may be a treadmill preferably with a handle structure. The base may be part of the handle structure; and the switch is preferably positioned therein. Desirably the switch is positioned for hand operation and so that movement to the "on" position is away from the user on the machine and to the "off" position is toward the user.

BRIEF DESCRIPTION OF THE DRAWINGS

In the drawings which depict what is presently regarded as the preferred embodiments of the instant invention.

DESCRIPTION OF THE ILLUSTRATED EMBODIMENTS

Figure 1:
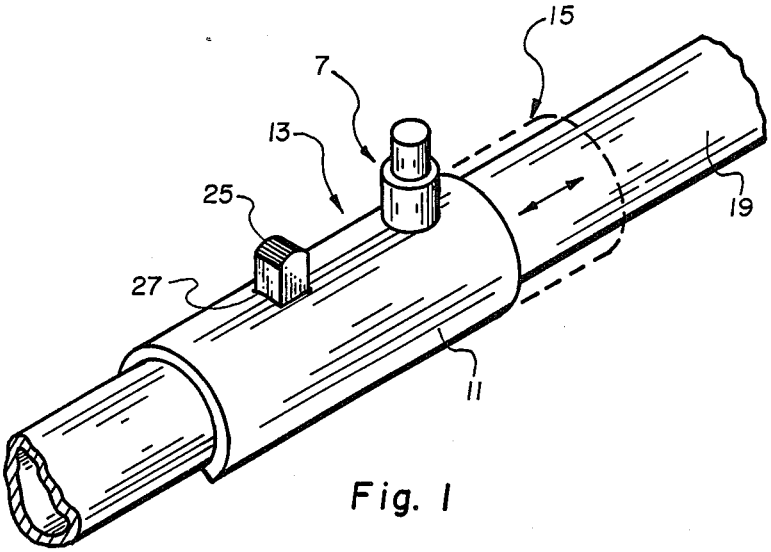
FIG. 1 is a perspective view of an embodiment of the switch of the invention in place on a portion of a typical handle for exercise equipment.

FIG. 1 shows in perspective, a switch assembly having base means which is here shown as a tubular portion 19 of handle structure of an exercise machine. Body means such as body 11 is adapted to the base means to slide thereover or relative thereto. As here depicted, the body 11 is a tubular shaped member sized to snuggly but slideably adapt over the tubular shaped handle portion 19. It should be recognized however that the base means may be any part of the chassis of an exercise machine such as treadmill 52 (FIG. 3) which may be conveniently accessible to the user. For example, the base means maybe a portion of the chassis proximate the feet of a user (for switch assembly operation by a foot of the user) with the body means being appropriate adapted structurally to slide thereover.

The switch assembly of FIG. 1 also has locking means such as structure 7 operable between an "operate" position and an "inhibit" position (shown). When the locking means is in the "operate" position, the body 11 is moveable from a first position 13 as shown to a second position 15 shown in dotted line format. When the locking means is in the "inhibit" position, the body 11 is not moveable from the first position 13. Switch means (not shown in FIG. 1) is adapted to the base means. In FIG. 1, the switch means is positioned under the base means and more specifically in the portion 19.

Figure 3:
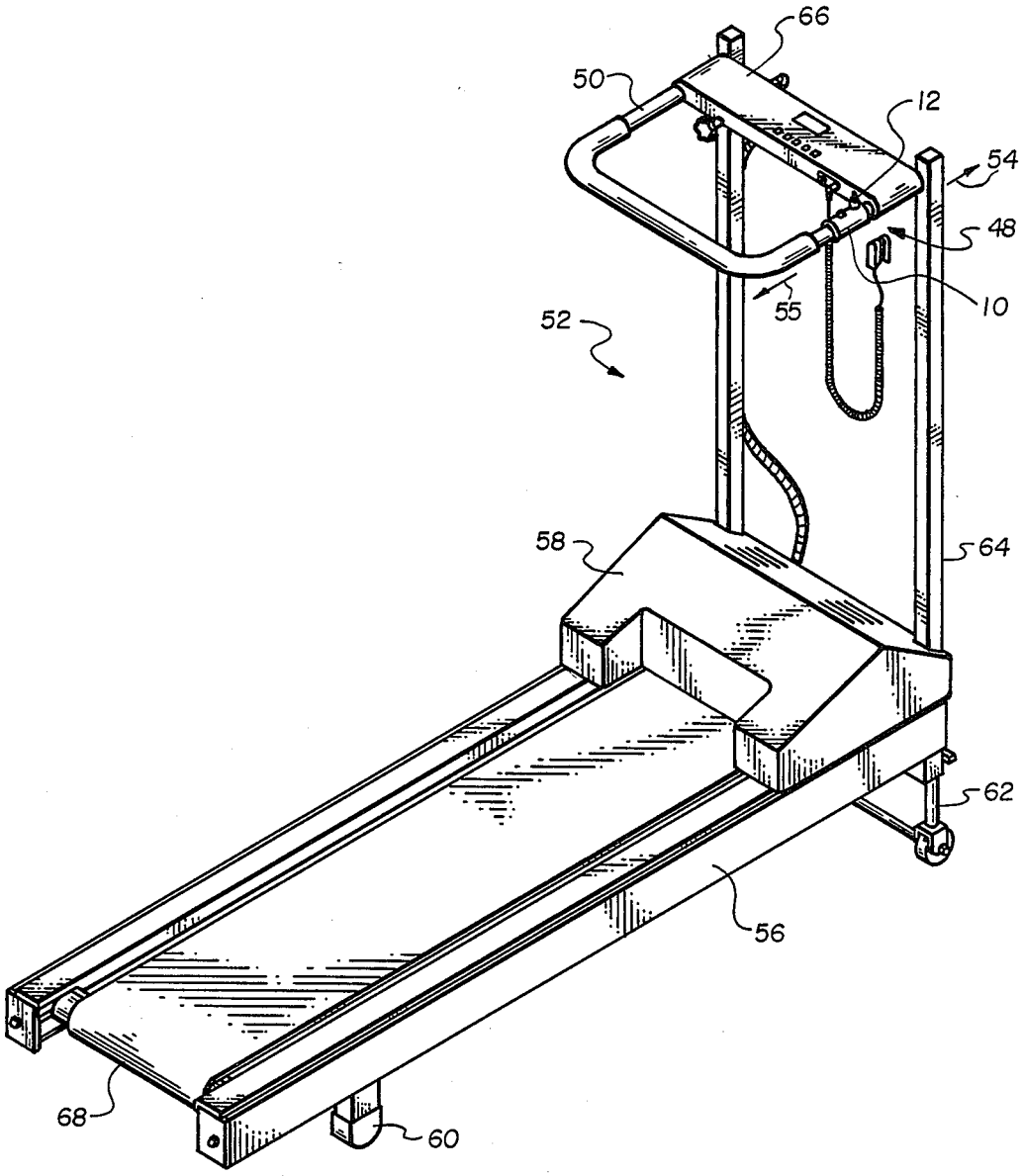
FIG. 3 is a perspective view of the embodiment of FIG. 1 in place on a typical treadmill exerciser.

The switch means may be any typical switch adapted to operate between an "on" and "off" position to respectively energize and de-energize, for example, the motor (not shown) of a motorized treadmill such as treadmill 52 (FIG. 3). A magnetic switch (e.g., a reed switch) may be suitable although, as here shown, a switch with an operating member 25 is preferred to provide for direct positive or mechanical control. The operating member 25 is operated or moved by connection means. In this embodiment, the connection means is an aperture (such as aperture 26) formed in the base means (e.g., portion 19) through which the operating member 25 extends. The aperture is sized to receive the operating member 25 and for movement thereof between its "on" and "off" positions. The connection means also includes another aperture 27 formed in the body 11 to register snuggly with the operating member 25 for movement thereof between its "off" and "on" positions upon movement of the body 11 between its respective first 13 and second 15 positions.

Figure 2:
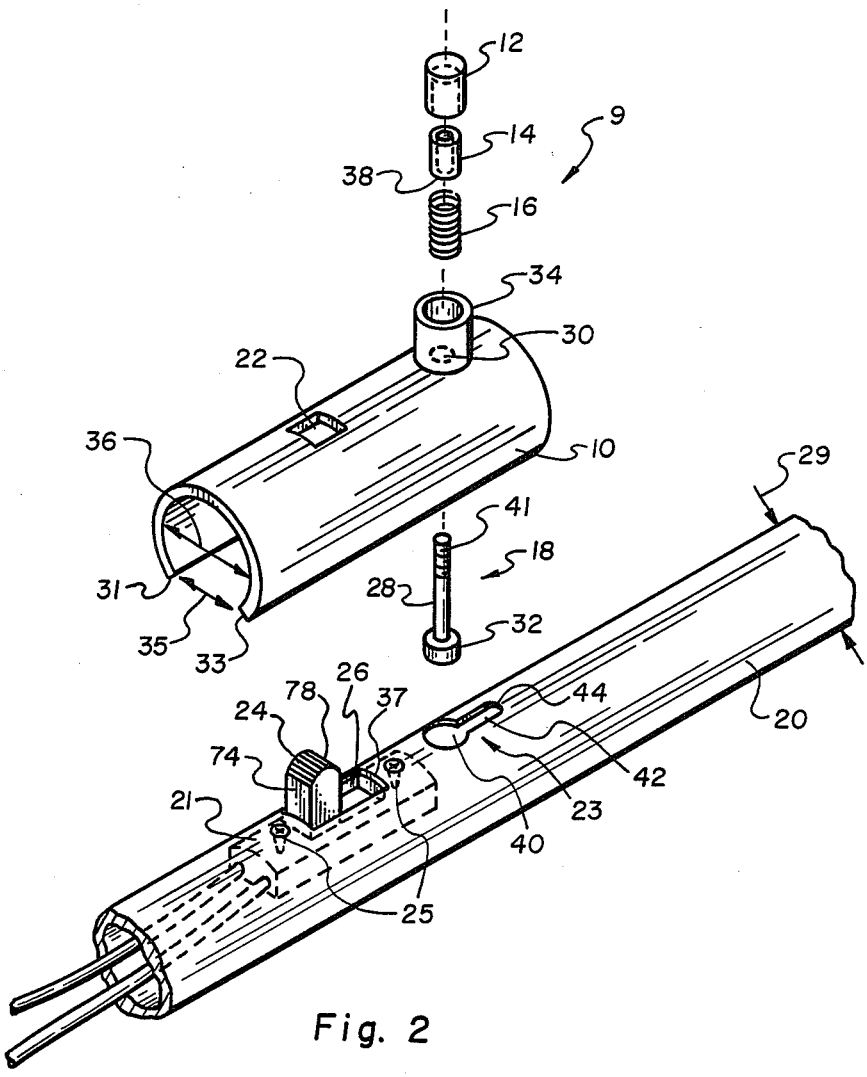
FIG. 2 is an exploded perspective view of an exbodiment similar to the embodiment illustrated in FIG. 1.

As shown in FIG. 2 a switch assembly of the present invention has a switch body 10, a locking means assembly 9 discussed more fully hereinafter, a base 20, an electrical switch 21 (shown in phantom) and connection means. The connection means includes a rectangular slot 22 or aperture in the switch body 10 and a rectilinear aperture 26 in the base 20.

The base 20 is here shown as a portion of a cylindrical tube. The switch body 10 is also shown generally cylindrical, with an interior diameter 36 just slightly larger than the exterior diameter 29 of the base 20. The switch body 10 is preferably made of plastic with its longitudinal ends 31, 33 spaced apart a distance 35 selected so that the ends 31, 33 may be forced apart to allow the body 10 to be clipped on to and over the base 20 so as to slide in relationship to the base 20 as generally shown in FIG. 1. When the switch body 10 is clipped on to the base 20, the rectangular slot 22 of the switch body registers with the operating member or toggle 24 of the electrical switch 21. The electrical switch 21 is adapted to the base 20 by any convenient means, which are here shown to be machine screws 25. The toggle 24 of the switch 21 slides within the rectilinear aperture 26 of the base 20. Thus, the switch body 10 slides along the base 20 to move the toggle 24 and in turn the electrical switch 21 between its "off" position as shown in FIG. 2 and the "on" position in which the toggle 24 is moved toward the front edge 37 of aperture 26.

The locking means assembly 9 here shown include's a nut 14, a spring 16 and a key 18. The shaft 28 of the key 18 is placed within a hole 30 formed in the switch body 10. The hole 30 is of smaller diameter than the head 32. Thus, the head 32, which is adapted to the distal and of the shaft as shown, precludes the key 18 from passing to the side of the switch body 10 which contains the collar 34. The spring 16 demonstrates biasing means and is sized to fit within the collar 34 and not pass through the hole 30. The nut 14 has interior threads 38 which connect with exterior threads 41 of the key 18. The nut 14 is sized to fit within the collar 34 and to hold the shaft 28 for relative movement through the hole 30 so that in effect the key 18 moves slidingly in relationship to the switch body 10, and the spring 16 serves to bias the head 32 of the key 18 towards the hole 30 of the switch body 10 (the "inhibit" position).

The button 12 is for operation by the user and is adapted to nut 14 in any convenient manner such as by press-fit which is shown. The button 12 is sized to slideably but snuggly fit within collar 34 and to protrude out from the collar a distance sufficient for easy movement such as shown in FIG. 1.

The head 32 of the key 18 is formed to register with and pass through the first portion 40 of a keyhole shaped slot 23. The head 32 of the key 18 at the same time is sized to not register with or pass through the second portion 42 of the slot 23. The shaft 28 of the key 18 is sized so as to register with and slide into and within the second portion 42 of the slot 23 when the head 32 is positioned through the first portion 40.

When the switch body 10 of the embodiment of FIG. 2 is clipped onto the bar section 20 similar to that illustrated in the embodiment of FIG. 1 and the button 12 protrudes outward from the switch body 10 as also depicted in FIG. 1, the head 32 of the key 18 is in registration ("inhibit" position) with and in the first portion 40 of the slot 23. Thus, the switch body 10 cannot be moved. When the button 12 is depressed toward the switch body 10 (operate position), the head 32 of the key 18 moves through the portion 40 inward of the base 20 and out of registration with the first portion 40 of the slot 23. The switch body 10 may then be moved or slid so as to bring the shaft 28 of the key 18 into the second portion 42 of the slot 23. As the shaft 28 of the key 18 abuts against the end 44 of the second portion 42, toggle 24 and in turn the electrical switch 21 is also moved to place electrical switch 21 in its "on" position.

To turn the electrical switch "off", the switch body 10 is slid in the opposite direction to bring the head 32 of the key 18 into registration with the first portion 40 of the slot 23, at which time the spring 16 urges the key 18 toward and the button 12 moves back into the "inhibit" position the same as depicted in FIG. 1.

A user turns on the exercise equipment by depressing button 12 and sliding the switch body 10 along the base section 20 to abut the shaft 28 against the end 44 of the second portion 42. In the event of an emergency, the exerciser or user would merely need to grasp the switch body 10 and slide it in the opposite direction used to turn the exercise equipment off.

FIG. 3 depicts a typical treadmill 52 having a chassis 56, a motor and drive assembly contained under cover 58, feet 60, legs 62, support structure 64, operating control assembly 66, handle structure 50 and an endless belt 68 upon which the user stands to exercise (e.g., walk, jog, run). A switch assembly of FIG. 2 is generally depicted at 48 on the handle bar 50 a portion of which here acts as the base 20 (FIG. 2). The switch assembly is here oriented similar to the orientation of FIG. 2. Therefore, an exerciser or user would depress the button 12 and slide the switch body 10 away from himself and towards the front 54 of the treadmill 52 to energize the machine and towards the user or rear 55 to de-energize the machine 52.

Figure 4:
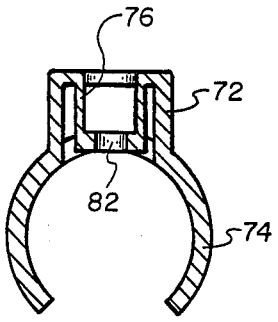
FIG. 4 is a representative cross sectional transverse view of alternative body means of the instant invention.
Figure 5:
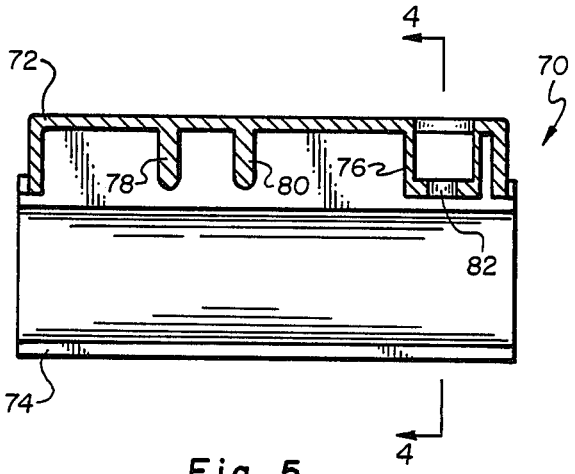
FIG. 5 is representative cross section longitudinal view of the alternative body means of FIG. 4 taken along line 4—4 of FIG. 5.

FIGS. 4 and 5 illustrate another embodiment 70 of the switch assembly of the instant invention. Switch body 70 has a rectangular crown 72 attached to the switch body 74. Connected to the interior of the crown 72 is a cylindrical extension 76 and two finger-like protrusions or pawls 78 and 80.

Cylindrical extension 76 functions in the same way as collar 34 in FIGS. 1 and 2. Hole 82 in cylindrical extension 76 functions the same way as hole 30 in switch body 10. When the body 70 is clipped onto base 20, cylindrical extension 76 registers with parts 12, 14, 16 and 18 to provide a locking means assembly that interacts with slot 23 so that body 70 can only slide along bar section 20 when button 12 is depressed.

Finger-like projections or pawls 78 and 80 register with the sides 84 and 88 of toggle 24 to urge toggle 24 and in turn switch 21 between its "on" and "off" positions. Body 70 may be preferable to body 10 in that it may be easier to install, more aesthetically pleasing (toggle 24 is hidden) and may reduce the risk of breakage of either the switch body or the electrical switch 21).

It is to be understood that in other embodiments the switch assembly may be reoriented with the locking means structure (e.g., 7 in FIG. 1 and 9 in FIG. 2) toward the user (55 in FIG. 3). Also for some powered machines it maybe desirable to orient the switch assembly of the instant invention to be placed in the "off" condition by moving the switch body (e.g., 10 of FIG. 2) away from the user. Such an arrangement may be advantageously used on exercise equipment where a fall might typically involve the user falling forward or toward the area of the exercise equipment containing the switch assembly. The switch assembly and in particular the switch body (e.g., 10 of FIG. 2) is also sized to be relatively large compared to switches which may be found on typical powered exercise equipment. For example, a typical treadmill may have a switch comparable to switch 21 (FIG. 2) positioned on or about its operating control assembly (e.g., 76 of FIG. 3). The large size of the switch assembly of the instant invention facilitates easier operation because it can be more quickly located and grasped.

Reference herein to details of the illustrated embodiments is not intended to restrict the scope of the appended claims, which themselves recite those features regarded as essential to the invention.

I claim:

1. A switch assembly for operation of a powered exercise machine, said switch assembly comprising:

base means having a keyhole aperture formed therein, said keyhole aperture having a first portion and a second portion, said second portion being smaller than said first portion;

body means slidingly associated with said base means to move between a first position and a second position;

switch means mechanically associated with said base means and operable between an "on" position to provide operational power to said powered exercise machine and an "off" position in which operational power to said powered exercise machine is interrupted;

locking means associated with said body means and operable between an operate position in which said body means is slideable between said first and second positions and an inhibit position in which said body means is not moveable from said first position, and wherein said locking means further comprises:

a button operable between said operate and inhibit positions, a key connected to said button, said key including a shaft operable by said button, and a head adapted at the distal end of said shaft, said head being positioned and sized to register with and pass through said first portion and to not pass through said second portion, and said shaft being sized to pass into said second portion when said head has passed through said first portion, and means for biasing said head and said button toward said inhibit position; and connection means associated with said body means to associate said body means with said switch means to operate said switch means from said "off" position to said "on" position upon movement of said body means between its first and second positions respectively with said locking means in said operate position.

2. A switch assembly according to claim 1 wherein said powered exercise machine is an electrically driven treadmill and wherein said switch means is an electrical switch.

3. A motorized treadmill comprising:

motorized treadmill means for performing treadmill exercises, said motorized treadmill means including a chassis;

handle means mechanically associated with said chassis and positioned for grasping by a user performing exercises on said motorized treadmill;

a keyhole aperture formed in said handle means with a first portion and a second portion, said first portion having a larger cross section than said second portion, and said handle means having a swtich toggle aperture formed therein proximate said keyhole aperture;

a switch adapted to and positioned within said handle means proximate said keyhole aperture and connected to energize and de-energize said motorized treadmill means, said switch being operable between an "on" position to energize and an "off" position to de-energize, and said switch having toggle means extending away therefrom for operation between said "on" and "off" positions and sized and positioned to extend through said switch toggle aperture;

a body slidably associated with said handle means proximate said keyhole aperture, said body having an aperture to register with said toggle means;

a button adapted to said body, said button having an "in" and an "out" position;

biasing means for biasing said button toward said out position; and a key positioned for actuation by said button, said key including a shaft operable by said button and a head adapted at the distal end of said shaft, said head being sized to register with and to pass through said first portion and said shaft being sized to pass into said second portion when said head has passed through said first portion.

4. A motorized treadmill according to claim 3, wherein said switch and body are positioned so that the body slides away from a user to place said switch in the "on" position and slides toward a user to place said switch in the "off" position.

* * * * *